United States Patent [19]

Haythornthwaite et al.

[11] 4,082,123

[45] Apr. 4, 1978

[54] CARBONATING APPARATUS

[75] Inventors: Peter F. Haythornthwaite; Victor K. Relf, both of Auckland, New Zealand

[73] Assignee: Sodaflo Drinks Limited, Wellington, New Zealand

[21] Appl. No.: 735,338

[22] Filed: Oct. 26, 1976

[51] Int. Cl.[2] ..... B65B 31/06

[52] U.S. Cl. ..... 141/64; 141/97

[58] Field of Search ..... 141/64, 70, 97, 37–70

[56] References Cited

U.S. PATENT DOCUMENTS

| | | | |
|---|---|---|---|
| 711,459 | 10/1902 | Bastian | 141/64 |
| 751,397 | 2/1904 | Hucks | 141/64 |
| 1,561,036 | 11/1925 | Sugden | 141/64 |

*Primary Examiner*—Houston S. Bell

*Attorney, Agent, or Firm*—Stevens, Davis, Miller & Mosher

[57] ABSTRACT

A beverage carbonating apparatus for consumer use comprises a stand supporting a gas bottle and a nozzle, for insertion into the neck of a container holding the beverage to be carbonated, the nozzle being pivoted to the stand for movement about a horizontal axis between a first, inclined position where the container nozzle may be inserted into or removed from the container and a second, vertical position where carbonation occurs.

21 Claims, 4 Drawing Figures

CARBONATING APPARATUS

BACKGROUND OF THE INVENTION

This invention relates to carbonating apparatus and is particularly, although not solely, designed for domestic use.

Previously known apparatus used to carbonate liquid (usually water or a water solution) for domestic use in making soft drink beverages has an outer casing or housing with a gas injecting nozzle located within the housing. This housing is frequently a cylindrical tube. The gas injecting nozzle is connected to a cylinder of compressed carbon dioxide gas. A container, preferably a bottle, containing the liquid to be carbonated is located within the housing with the nozzle passing through the opening of the bottle and submerged in the liquid. A clamping arrangement at the base of the bottle presses the neck of the bottle against a seal and holds the bottle in place during carbonation. A suitable valving arrangement and activating mechanism allow an injection of gas into the bottle to carbonate the liquid held therein. The apparatus has a pressure release means which operates when the appropriate charge of gas has been introduced to prevent an excessive build up of pressure in the bottle.

The casing or housing is designed to protect the user of the apparatus should the bottle or other container break during carbonation. This housing is either located at a suitable angle to allow for ease of access of the bottle or other container or is instead located at a sufficient height above a base to allow the bottle or other container to be introduced beneath the housing and be moved vertically into place. In either case, the apparatus tends to be bulky.

BRIEF SUMMARY OF THE INVENTION

In one aspect the present invention consists in a carbonating apparatus comprising a stand containing a gas bottle, an injecting nozzle pivotally mounted to the stand for movement about a substantially horizontal axis, said nozzle being adapted to pass through an opening of a bottle or other container and into a liquid contained therein, said nozzle being pivotal between a first inclined position allowing the bottle or other container holding the liquid to be carbonated to be introduced into the apparatus and to be penetrated by said nozzle and a second substantially upright position there being supporting means to support the bottle at said second position so that said liquid may be carbonated by gas introduced through said nozzle from said gas bottle via a gas supply system.

In a second aspect the present invention consists in a carbonating apparatus comprising a stand adapted to support a gas bottle, a housing pivotally mounted to the stand and carrying a gas injecting nozzle, the housing being adapted to receive a bottle or other container of liquid to be carbonated and being pivotal between a first position where the housing is swung away from the stand to allow the bottle or other container to be inserted or removed from the housing and a second position where the housing lies close to the stand and the bottle or other container is enclosed for protection in the event that the bottle or other container breaks during carbonation, and means to seal off the open mouth of the bottle or other container when at the second position with the nozzle entering the mouth and means enabling gas to be injected from the gas bottle through the nozzle when the nozzle is in the second position.

BRIEF DESCRIPTION OF THE DRAWINGS

A preferred form of the present invention will now be described with reference to the accompanying drawings in which.

DETAILED DESCRIPTION OF THE INVENTION

Figure 1:
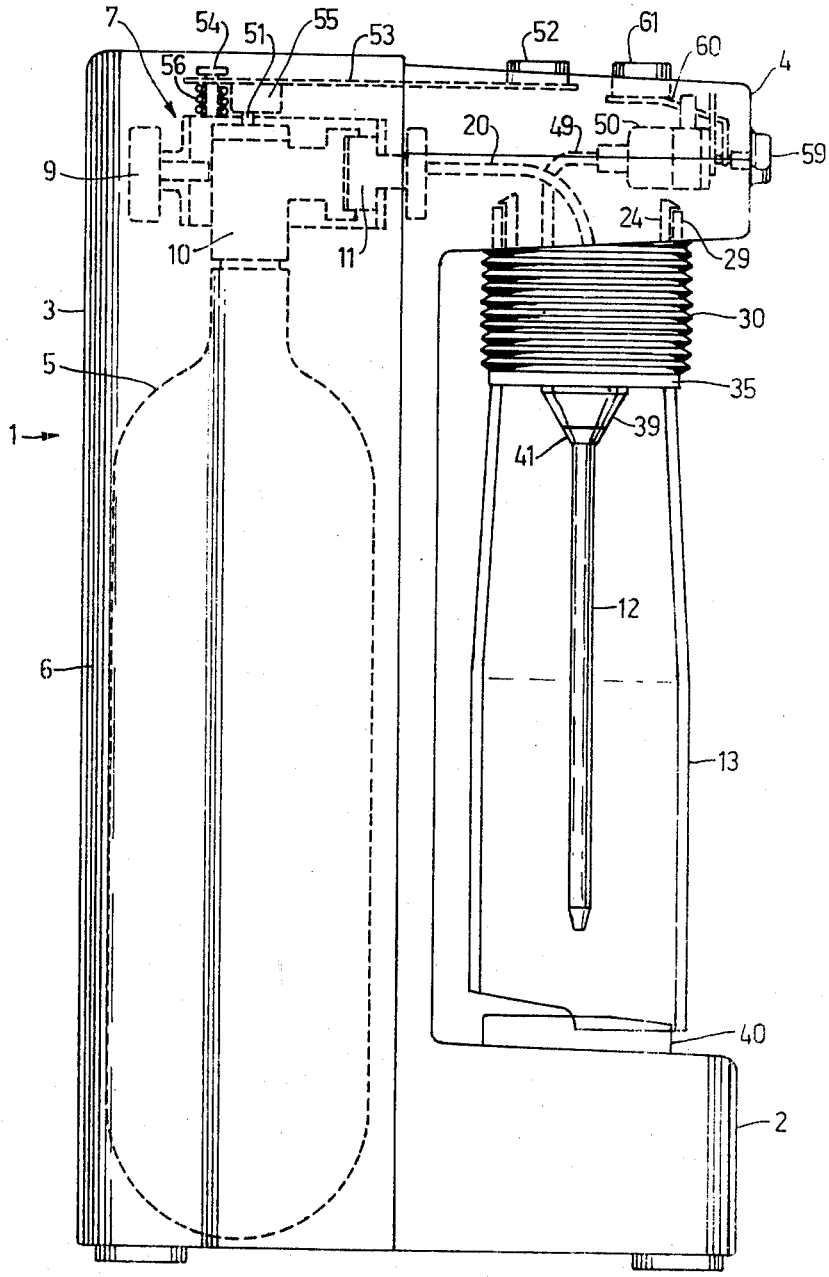
FIG. 1 is a side elevation of a preferred form of the carbonating apparatus.

In a preferred form of the present invention, the carbonating apparatus has a stand 1 embodying a foot 2, an upstand or colum 3 and a head 4. The foot and head project from the column so that the head is located directly above the foot when the apparatus is in the upright position. The stand 1 is adapted to support a gas bottle 5 which usually contains carbon dioxide under pressure. This gas bottle 5 is located within the column 3 of the apparatus. In the arrangement shown in FIG. 1 the gas bottle 5 is held in position within the column 3 by a clamp assembly 7 which has a clamp knob 9 bearing against the gas bottle valve 10 to provide a sealed arrangement with the bottle valve acceptor 11 which is attached to the head 4 of the stand 1. A 'U' shaped cover 6, which is preferably moulded in a plastics material, as is the stand itself, fits about the gas clamp assembly 7 and engages with the column 3. A finger recess (not shown) may be provided in the rear of the cover 6 to enable easy removal of the cover from the stand when it is necessary to replace the gas bottle 5.

The carbonating apparatus has an elongated injecting nozzle 12 which is pivotally mounted with respect to the stand 1. This injecting nozzle 12 is adapted to pass, in use, through an opening of a bottle or other container and into the liquid contained therein. The nozzle is movable between a first position which allows the bottle or other container holding the liquid to be carbonated to be introduced into the apparatus and removed therefrom and a second position, such as that shown in FIGS. 1 and 2, where the bottle or other container is held and may be carbonated.

It is important that the user of the carbonating apparatus be protected in case the bottle or other container should break during carbonation under the pressure of the compressed carbon dioxide used. For this reason the apparatus has a shield which may be positioned between the bottle or other container and the user during carbonation. This shield is movable or removable to allow access for the bottle or other container to the apparatus. In the preferred arrangement the shield and the injecting nozzle 12 are in fixed location to each other and are pivotal together, the shield comprising a substantially cylindrical housing 13 which is open at one end, this being the bottom end in use. The housing is pivotally mounted at or adjacent the top end and the injecting nozzle 12 extends substantially centrally down the tubular housing 13 from the top end. The housing 13 may be made from any suitable material such as a metal, but is preferably made of a transparent plastics material so that the bottle or other container may be observed during carbonation, and it is obvious by looking at the apparatus whether or not there is a bottle or other container in the apparatus.

Figure 4:
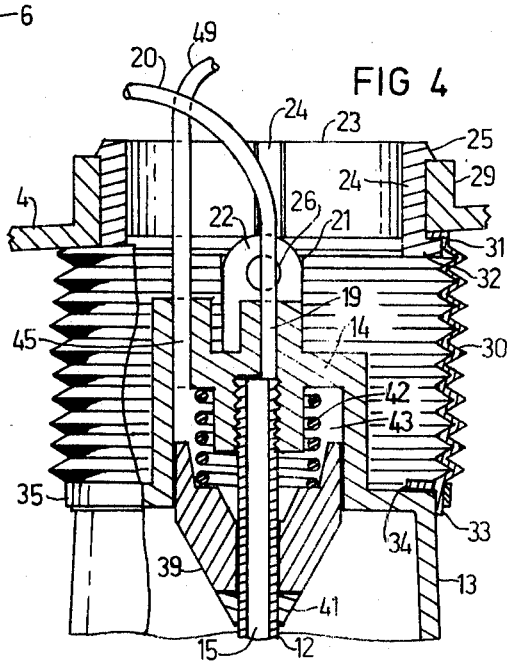
FIG. 4 is a partial section on AA of FIG. 2 showing the preferred arrangement whereby the injecting nozzle and the housing are pivotal with respect to the stand.

The preferred arrangement, though this is obviously not the only arrangement, whereby the nozzle 12 and the housing 13 are pivotal with respect to the stand has the nozzle 12 screwed into or otherwise secured to a mounting 14 so that the bore 15 of the injecting nozzle 12 is in communication with a gas inlet passage 19 in the mounting 14 to which is fastened a flexible gas inlet tube 20. This gas inlet tube 20 in turn communicates with the bottle valve acceptor 11. The mounting 14 may be made separately from the housing 13 but preferably forms an integral part of the housing so that the two may be moulded together. This mounting 14 is pivoted about a substantially horizontal axis (when the apparatus is upright) to a fixed part of the apparatus and FIG. 4 shows a preferred arrangement.

Projecting from the underside of the head 4 of the stand there are two lugs 21 between which are located two corresponding lugs 22 attached to the mounting 14. Appropriate pivot screws 26 or pins or the like are fitted through these lugs 21 and 22 to complete the pivotal attachment. The lugs 21 may be fixed to the underside of the head 4 or instead, as shown in FIG. 4, may be detachable from the head. In this case, the lugs 21 are attached to and project from a pivot holder 23 which is arranged, in use, to engage with a snap engagement in the head 4 of the stand 1. The pivot holder 23 has four evenly spaced catch arms 24, each with an inclined upper face 25, to allow the pivot holder 23 to be moved into a snap action with an inwardly turned lip 29 surrounding a hold provided in the underside of the head 4 for the pivot holder 23.

Extending between the pivot holder 23 and the top of the housing 13 is a cover or sleeve 30. The top of the cover has an inturned lip 31 engageable with a shoulder 32 provided on the pivot holder 23. The cover or sleeve 30 has a concertina section which allows for flexing as the nozzle 12 and housing 13 are pivoted in use. To ensure that the flexible cover or sleeve is fixed to the housing a skirt section 33 engages over the upper part of the housing and an internal lip 34 butts against the top of the housing. The skirt 33 is held in place by a clamping ring 35. This cover or sleeve 30 serves to conceal the mounting and the pivot.

Figure 2:
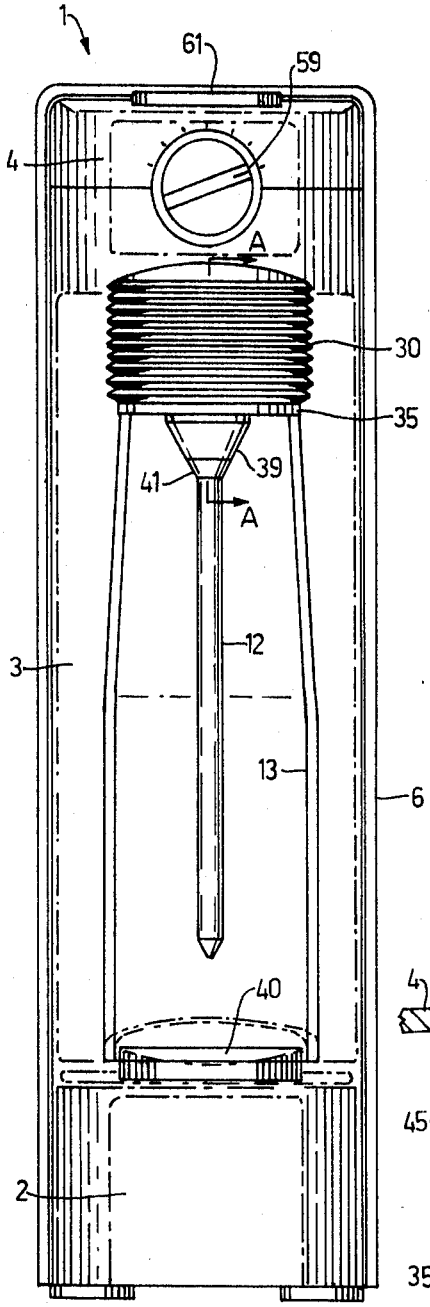
FIG. 2 is a front view of the carbonating apparatus shown in FIG. 1.
Figure 3:
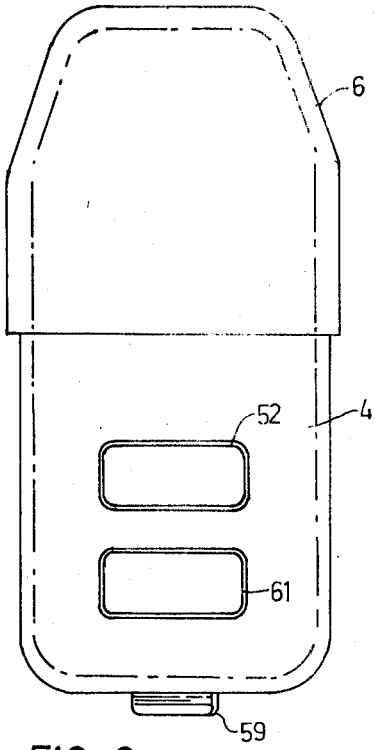
FIG. 3 is a plan view of the carbonating apparatus from above.

With the pivotal arrangement that has been described, the nozzle 12 and housing 13 which are shown in the second position in FIG. 1 may be pivoted outwardly to the right to the first position, where a bottle or other container may be inserted into or removed from the housing 13.

Except for the injecting nozzle 12 which passes through the opening of the bottle or other container, in use, it is important that the rest of the opening be substantially sealed during carbonation, so that sufficient pressure may be produced within the bottle or other container to ensure adequate carbonation of the liquid. For this purpose a seal assembly is provided. This may comprise a stopper 39 which is located towards the top of the injecting nozzle 12 and which surrounds the nozzle, this stopper being adapted to substantially seal the opening of the bottle or other container. Engagement means are provided for ensuring that the stopper 39 lies over or against or in the opening to effect the seal. In one form of the apparatus, the engagement means includes a base 40 upon which the bottle or other container may sit when in position for carbonation, this base 40 being located on the upper surface of the foot 2 of the stand 1, and means to move the base 40 upwardly to press the opening of the bottle or other container against the stopper 39 which in this case would be fixed in position around the nozzle 12. Suitable means for moving the base include a shaft bearing a cam, this shaft being rotatably mounted within the foot 2 of the apparatus and below the base 40 so that the cam bears against the underside of the base or against a projection from the underside of the base. One (or both) ends of the shaft would project through the side of the foot 2 and would have an operating lever attached at this end.

However, in the preferred form of the invention the apparatus has the base 40 fixed in position and the stopper 39 is slideable along the nozzle 12 to press, in use, against the opening of the bottle or other container under the influence of biasing means. The lower movement of the stopper 39 is limited by a fixed collar 41. The preferred biasing means comprises a helical coil spring 42 which biases the stopper 39 towards the collar 41 and the base 40. The distance at which the stopper is located above the base is slightly less than the height of the bottles or other containers used with the apparatus so that when these are inserted into the housing 13 and this is pivoted to the second position so that the bottle or other container stands on the base 40, the stopper 39 is lifted off the fixed collar 41 slightly by the neck of the bottle or other container and presses against the opening under the influence of the spring 42. However, during carbonation high gas pressures may be generated within the bottle or other container which may unseat the stopper 39 from the opening unless a very strong spring is used. For this reason it is desirable that a secondary bias be provided to assist the action of the spring.

This secondary bias may be conveniently provided by the pressure of the carbonating gas acting on the stopper 39 once the carbonating cycle has been initiated. As shown in FIG. 4, the stopper 39 is sealingly slideable in a chamber 43 which forms part of the pivoted end of the nozzle, there being a passage allowing gas introduced into the bottle or other container to enter the chamber 43. This passage may be provided between the nozzle 12 and the stopper 39 if the stopper is a relatively loose fit about the nozzle. The area of the stopper 39 exposed to gas in the chamber 43 is greater than the area exposed to gas in the bottle or other container so that during carbonation and under the effect of the differential force created by equal pressures operating oppositely on unequal areas of the stopper, a secondary bias is provided forcing the stopper into sealing engagement with the bottle or other container. The preferred arrangement has the chamber 43 formed in the mounting 14 by which the housing 13 is pivotally attached to the stand 1. From the chamber 43 a gas release passage 45 passes out of the chamber and is connected to a flexible outlet tube 49 which in turn communicates with a pressure release valve 50.

The apparatus has an activating mechanism for releasing gas from the gas bottle 5. Any suitable mechanism may be used for this purpose. This basically must provide means for depressing the gas release pin 51 normally associated with such gas bottles and the operating knob or button 52 could be located directly above the pin 51. However, in the arrangement shown in FIG. 1 the operating button 52 is located on the upper surface of the head 4 of the apparatus and is some distance from the pin 51 of the gas bottle 5. To operate the gas release pin, a lever 53 is provided which has an adjustable fulcrum located adjacent to the pin 51 of the gas bottle so that the lever when depressed about its pivot depresses the pin of the gas bottle to release gas. The pivot adjustment caters for the different heights of the gas release pins often encountered in use. This adjustment may be provided by having an adjustable fulcrum screw 54 which is mounted on the clamp assembly 7. A biasing spring 56 is located about the fulcrum screw 54 between the clamp assembly 7 and the underside of the lever 53. An operating head 55 may be attached to the underside of the lever 53 to bear against the pin in use.

As has been mentioned, the apparatus has a pressure release valve 50 in communication with the gas supply system to allow gas to escape from the bottle or other container when a predetermined pressure has been reached. It is preferable, though not essential, that the pressure release valve be adjustable to provide different pressure settings so that in use the degree of carbonation of the liquid may be determined by the particular setting of the pressure release valve. This setting may be chosen by use of an adjustment knob 59. The adjustable operating shaft within the pressure release valve 50 may have a spline head with a complementary spline in the appropriately mounted adjustment knob 59. The adjustment knob may be located by means of a circumferential lip which engages in a corresponding groove in the head 4 so that the user may not by exerting an inward pressure on the adjustment knob influence the operation of the pressure release valve. A lever 60 is depressable by pressing a release knob or button 61 to open the pressure release valve 50 to release the gas pressure from the bottle or other container and thus allow the housing 13 to be moved to the first position where the bottle or other container may be removed. Such a lever 60 and the release button 61 may not be needed in the form of the apparatus where the stopper 39 is fixed and the base 40 is movable, as lowering the base 40 after carbonation will allow the pressure within the bottle or other container to be released. When assembled as illustrated in the drawings the present invention is ready for use. The housing 13 may be gripped by a user and pivoted outwardly clear of the base 40 to the first position.

The lower periphery of the housing 13 is shaped to permit the housing to pivot past the base 40 and yet provides the user with adequate protection if, for any reason, a bottle or other container should break during carbonation. The rear part of the housing 13 is struck away from the centre line, as illustrated in FIG. 1, so that the housing can be pivoted out to the first position without fouling the base 40. In this tilted position a bottle or other container containing liquid may be placed inside the housing 13 with the injecting nozzle 12 passing through the opening to the bottle or other container and with the stopper 39 bearing against the opening to the bottle or other container. As the housing 13 is returned to the second position the bottom of the bottle or other container is supported by the base 40 and the neck of the bottle forces the stopper 39 upwardly slightly, against the biasing spring 42, into the chamber 43 provided within the mounting of the housing 13. The user may then depress the operating button 52 which in turn will depress the lever 53 and the operating head 55 which bears against the gas bottle pin 51 thus allowing a charge of compressed carbon dioxide gas to pass through the gas inlet tube 20 and the gas inlet passage 19 to the bore 15 of the injecting nozzle and thus into the liquid held in the container. As the gas pressure builds up in the bottle or other container gas passes between the injecting nozzle 12 and the stopper 39 into the chamber 43. A small hole could be provided directly between the gas inlet line and the chamber instead if desired. Because the area of the stopper upon which the gas pressure may operate in the chamber 43 is greater than the area of the stopper over the opening to the bottle or other container a differential force is generated causing the stopper 39 to be held in a sealing engagement against the opening to the bottle or other container. The gas pressure is also transmitted from the chamber 43 via the gas release passage 45 and the outlet tube 49 to the pressure release valve 50 and once the pre-set pressure is reached this valve opens thus preventing a further increase in pressure and indicating to the user that the appropriate charge of gas has been introduced into the bottle or other container. The user then releases the operating button 52 and presses the release button 61 thus fully opening the valve 50 and exhausting the free gas which is still contained at pressure within the bottle or other container. When this pressure has been relieved the housing 13 can then be pivoted to the first position whereupon the user may remove the bottle or other container of carbonated liquid. It is an advantage of this invention that the means to seal off the open mouth of the bottle or other container are effectively operable only when the housing is in the second position where the bottle or other container is supported by the base. If a user should insert a bottle into the housing and inadvertently inject gas into the bottle while the housing is still in the first position, then the gas pressure will tend to unseat the bottle from the stopper and allow gas to escape before any great pressure can build up.

A preferred form of the present invention has now been described with some possible modifications. However, many other modifications may be made to the apparatus. For example, in the form of the invention where the base is movable this may operate from the gas pressure or from hydraulic means rather than having mechanical means of operation. In the case where the stopper is movable this could be operated hydraulically or mechanically. The apparatus may also include interlock protection, to ensure that the apparatus cannot be operated until the components are correctly located, for example the operating button and lever may be interlocked so that a user cannot depress this button or activate the gas system until the housing 13 is returned to the second position with the bottle or other container correctly located therein. Other arrangements are possible whereby the gas bottle may be positioned or held within the column 3. Instead of the clamping assembly 7 as shown in FIG. 1 a suitable gas bottle attachment which is mounted towards the top end of the column 3 may have a vertical hole passing through it, this hole being threaded. Such an attachment would be suitable for use with gas bottles which have a threaded attachment about their neck so that the gas bottle may be screwed into the mounting with the pin of the gas bottle being located within the upper end of the hole in the mounting or projecting above the mounting so that this pin is accessible to an operating head or the like by which the pin may be depressed in use.

The preferred form of the invention described has the injecting nozzle 12 and the housing 13 in fixed location to each other and pivotal together. However, the nozzle could be located within and substantially enclosed by a suitable casing. This casing would have an opening in the side through which a bottle or other container could be introduced and a shield would be provided to close this opening during carbonation, this shield being separated from the nozzle. Such a shield could be hinged to the sides or top or bottom of the opening in a manner somewhat similar to a door or instead may be completely removable from the casing. In this case, the shield may have hooks at its side edges adapted to engage with pins projecting from the casing when the shield is in position so that the shield cannot be dislodged from the casing should a bottle break during carbonation. The injecting nozzle itself would still be pivotal with respect to the casing, preferably being pivotally attached at or adjacent the top end of the casing and adapted to pivot outwardly towards or through the opening provided in the side of the casing to allow for the insertion of a bottle or other container over the nozzle which would then be swung back with the bottle or other container to within the casing whereupon the shield would then be correctly positioned before carbonation. It is desirable that, if this arrangement is used, there be a safety mechanism which prevents gas pressure being released into the bottle or other container when the shield is not correctly positioned across the opening.

By having such a pivotal arrangement of the gas injecting nozzle, and perhaps the protective housing, a more compact and convenient arrangement, particularly for domestic use, is provided.

We claim:

1. A carbonating apparatus comprising a stand holding a gas supply means, an injecting nozzle pivotally mounted to the stand for movement about a substantially horizontal axis, said nozzle being adapted to pass through an opening of a bottle or other container and into a liquid contained therein, said nozzle being pivotal between a first inclined position allowing the bottle or other container holding the liquid to be carbonated to be introduced into the apparatus and to be penetrated by said nozzle and a second substantially upright position, supporting means to support the bottle at said second position so that said liquid may be carbonated by gas introduced through said nozzle from said gas supply means via a gas supply system means to seal the opening of the bottle or other container while being carbonated, said means comprising a stopper on said ejecting nozzle, said stopper being slideable along the nozzle to press against the opening of the bottle or other container under the influence of biasing means.

2. A carbonating apparatus as claimed in claim 1 wherein the apparatus has a shield which may be positioned to ensure that the bottle or other container is enclosed during carbonation, said shield being movable or removable to allow access to the bottle or other container.

3. A carbonating apparatus as claimed in claim 2 wherein the shield and the injecting nozzle are in fixed location to each other and are pivotal together.

4. A carbonating apparatus as claimed in claim 3 wherein the shield is a substantially cylindrical housing open at one end, this being the bottom end in use, and pivotally mounted or at adjacent the top end, the injecting nozzle extending substantially centrally down the housing from the top end.

5. A carbonating apparatus as claimed in claim 4 wherein the housing is made of a transparent material.

6. A carbonating apparatus as claimed in claim 1 including engaging means for ensuring that the stopper lies over or against or in the opening to effect the seal, said engaging means including a base upon which the bottle or other container may sit when in position for carbonation, and means to move the base to press the opening of the bottle or other container against the stopper which is fixed in position around the nozzle.

7. A carbonating apparatus as claimed in claim 1 including engaging means for ensuring that the stopper lies over or against or in the opening to effect the seal, said engaging means including a fixed base upon which the bottle or other container may sit when in position for carbonation.

8. A carbonating apparatus as claimed in claim 1 wherein the biasing means comprises a spring which biases the stopper towards the base and a secondary bias is provided by the pressure of the carbonating gas acting on the stopper once the carbonating cycle has been initiated.

9. A carbonating apparatus as claimed in claim 8 wherein the stopper is sealingly slideable in a chamber which forms part of the pivoted end of the nozzle, there being a passage allowing gas introduced into the bottle or other container to enter the chamber and the area of the stopper exposed to gas in the chamber is greater than the area exposed to gas in the bottle or other container so that under the effect of the differential force created by equal pressures operating oppositely on unequal areas of the stopper, the stopper is forced into sealing engagement with the bottle or other container.

10. A carbonating apparatus as claimed in claim 1 wherein the apparatus includes an activating mechanism for releasing gas from the gas supply means the activating mechanism comprising a lever with an adjustable fulcrum located adjacent to the pin of the gas supply means so that the lever, when depressed about its pivot, depresses the pin of the gas supply means to release gas, and the pivot adjustment caters for the different heights of the gas release pins.

11. A carbonating apparatus as claimed in claim 1 wherein the apparatus has a pressure release valve in communication with the gas supply system to allow gas to escape from the bottle or other container when a predetermined pressure has been reached.

12. A carbonating apparatus as claimed in claim 11 wherein the pressure release valve is adjustable, different pressure settings being provided so that the degree of carbonation of the liquid may be determined by the particular setting of the pressure release valve.

13. A carbonating apparatus as claimed in claim 2 wherein the nozzle is secured to a mounting and is in communication with a gas inlet passage in the mounting to which is fastened a flexible gas inlet tube and the mounting is pivoted about a substantially horizontal axis.

14. A carbonating apparatus as claimed in claim 13 wherein the mounting forms an integral part of the shield.

15. A carbonating apparatus as claimed in claim 14 wherein at least the top of the shield is tubular and a flexible concertina type sleeve is fastened to the top of the shield and to the fixed part of the apparatus in a manner which conceals the mounting and the pivot.

16. A carbonating apparatus comprising a stand adapted to support a gas supply means, a housing pivotally mounted to the stand and carrying a gas injecting nozzle, the housing being adapted to receive a bottle or other container of liquid to be carbonated and being pivotal between a first position where the housing is swung away from the stand to allow the bottle or other container to be inserted or removed from the housing and a second position where the container lies close to the stand and the bottle or other container is enclosed for protection in the event that the bottle or other container breaks during carbonation, and stopper means to seal off the open mouth of the bottle or other container when at the second position with the nozzle entering the mouth and means enabling gas to be injected from the gas supply means through the nozzle when the nozzle is in the second position, said stopper means having biasing means to press it against said open mouth, said biasing means comprising a chamber above the stopper which is charged with gas pressure and in which a portion of stopper is sealingly slideable, that portion having a greater area exposed to the gas than the stopper portion which is exposed to the gas in the bottle or other container so that under the effect of the differential force created by equal pressures operating oppositely on unequal areas of the stopper, the stopper is forced into sealing engagement with the bottle or other container.

17. A carbonating apparatus as claimed in claim 16 wherein the stopper means to seal off the open mouth of the bottle or other container are operable only when the housing is in the second position.

18. A carbonating apparatus as claimed in claim 17 wherein the housing is pivoted at the top to the stand about a substantially horizontal axis.

19. A carbonating apparatus as claimed in claim 17 including a base support for the bottle or other container which is movable upwardly when the housing holding the bottle or other container is in the second position to force the bottle or other container upwardly so that the mouth is sealed off by the stopper means.

20. A carbonating apparatus as claimed in claim 17 wherein the pivotal housing completely surrounds the bottle or other container except for the base thereof.

21. A carbonating apparatus as claimed in claim 17 wherein the apparatus includes a pressure release valve which is in communication with the interior of the bottle or other container during carbonation and which releases gas when a predetermined pressure has been reached.

* * * * *